US005718814A

United States Patent [19]

Schimion

[11] Patent Number: 5,718,814

[45] Date of Patent: Feb. 17, 1998

[54] SEPARATING PLANT FOR METALS FROM A METAL-CONTAINING ELECTROLYTE

[75] Inventor: Werner Schimion, Hilchenbach, Germany

[73] Assignee: SMS Schloemann-Siemag Aktiengesellschaft, Düsseldorf, Germany

[21] Appl. No.: 621,780

[22] Filed: Mar. 22, 1996

[30] Foreign Application Priority Data

Mar. 23, 1995 [DE] Germany ..... 195 10 667.9

[51] Int. Cl.[6] ..... C25D 17/00; C25D 19/00

[52] U.S. Cl. ..... 204/206; 204/224 R; 204/237; 204/269

[58] Field of Search ..... 204/206, 207–210, 204/269, 237, 224 R

[56] References Cited

U.S. PATENT DOCUMENTS

| | | | |
|---|---|---|---|
| 3,864,235 | 2/1975 | Bobrov et al. | 204/206 |
| 4,434,040 | 2/1984 | Brendlinger | 204/206 |
| 4,655,894 | 4/1987 | Podrini | 204/206 |
| 4,762,602 | 8/1988 | Bechem et al. | 204/206 |

FOREIGN PATENT DOCUMENTS

| | | |
|---|---|---|
| 0196420 | 10/1986 | European Pat. Off. . |
| 3901807 | 7/1990 | Germany . |
| 4139066 | 6/1993 | Germany . |

*Primary Examiner*—Donald R. Valentine
*Attorney, Agent, or Firm*—Friedrich Kueffner

[57] ABSTRACT

A separating plant for separating metals from an electrolyte which contains metal, particularly for coating steel strip, includes successively arranged vertical coating cells in which the strip to be coated is guided from an upper deflection roller and/or current-carrying roller to a lower deflection roller and from there to another upper deflection roller and/or current-carrying roller. The upwardly or downwardly travelling strip portion passes through a gap between vertically arranged anodes and an electrolyte flow which is circulated by means of pumps is fed into the gap, preferably in a direction opposite the strip travel direction. Two oppositely arranged walls of each coating cell are constructed as anode plates and adjacent anode plates of successive coating cells form a separating chamber.

12 Claims, 4 Drawing Sheets

SEPARATING PLANT FOR METALS FROM A METAL-CONTAINING ELECTROLYTE

BACKGROUND 8F THE INVENTION

1. Field of the Invention

The present invention relates to a separating plant for separating metals from an electrolyte which contains metal, particularly for coating steel strip. The plant includes successively arranged vertical coating cells in which the strip to be coated is guided from an upper deflection roller and/or current-carrying roller to a lower deflection roller and from there to another upper deflection roller and/or current-carrying roller. The upwardly or downwardly travelling strip portion passes through a gap between vertically arranged anodes and an electrolyte flow which is circulated by means of pumps is fed into the gap, preferably in a direction opposite the strip travel direction.

2. Description of the Related Art

A plant of the above-described type has become known from EP 0 196 420 B1. In this known plant, separate housings are arranged around the anodes forming the anode/cathode chambers or separating chambers for the upwardly travelling strip portion as well as for the downwardly travelling strip portion. Electrolyte flows are separately circulated through the housings by means of liquid jet pumps arranged in the space between the housing walls of the outer housing and the anodes. By supplying the electrolyte flow at a high speed against the strip travel direction, a very turbulent counter-current flow is produced which accelerates the electrolytic separation. The upper housing surrounding the two pairs of anodes is completely filled with electrolyte up to an overflow. This not only means that the energy requirement for circulating the electrolyte is greater, but also causes the assembly as well as the maintenance and repair of the coating cells to be more complicated and expensive. In addition, the electrolyte which is pressed in through jet nozzles at increased pressures reaches flow velocities which can no longer be controlled and regulated. Also, accumulations of ferrous hydroxide sludge at the bottom of the cell cannot be prevented.

SUMMARY OF THE INVENTION

Therefore, it is the primary object of the present invention to provide a separating plant of the above-described type for the electrolytic separation of metals, particularly of zinc, from aqueous solutions of metal salts, which is simpler and less expensive.

In accordance with the present invention, two oppositely arranged walls of each coating cell are constructed as anode plates and adjacent anode plates of successive coating cells form a separating chamber.

Accordingly, the separation effected by electrical current is limited to a separating chamber which is formed, on the one hand, by the insoluble anode plates of the parallel longitudinal walls of the anodes of adjacent coating cells and, on the other hand, by closing plates which are arranged at the two lateral openings of the pair of anode plates and can preferably be moved in and out.

Accordingly, a box-shaped separating chamber is provided which is open toward the top and toward the bottom, wherein the strip to be coated is guided through the center of the separating chamber seen in longitudinal direction and parallel to the anode plates and to the lateral closing plates. The electrolyte which is pumped in and through under pressure only fills out completely with electrolyte the two partial chambers created by the strip travelling through the box-shaped separating chamber between the strip and each anode plate. The two partial chambers constitute very flat rectangular ducts.

Electrolyte is contained only in the partial chambers and not in the rest of the coating cell. Accordingly, the coating cell is a dry cell and a cassette-type construction or modular construction of the coating plant is possible in a simple manner. Each coating cell or cassette can be constructed as a complete operational unit and can be moved out of the plant in a very short time with the strip being in place. Accordingly, inspections, adjustments and repairs can be carried out outside of the coating line and in a separate workshop. Moreover, by providing replacement coating cells, it is possible to carry out an exchange of the dry cell in a very short time in the case of malfunctions during operation, so that production and maintenance costs are reduced.

The coating cell according to the present invention can be carried out in an open frame construction, i.e., only lateral closing walls are provided; these lateral closing walls are the oppositely located anode plates of a coating cell; on the other hand, the end faces of the coating cell are open. The tubing and the means for distributing the electrolyte flowing into and out of the separating chamber or the two partial chambers thereof can be located in the free space between the two anode plates. Alternatively, the coating cell may have a closed frame, i.e., a frame which is closed by means of walls also at the end faces.

A further development of the invention provides that inlet and outlet slots extending over the entire anode width are arranged at the upper and lower ends of the anode plates. Whether the inlet location is at the top or at the bottom depends on the respective travel direction of the strip. The slots advantageously are slot nozzles which are either arranged outside in front of the anode plates or they may be integrated in the anode plates. In any event, the slot nozzles ensure a flow velocity which is uniform over the entire width of the anodes and, thus, provide the necessary requirements for a uniform strip coating.

In accordance with an advantageous feature, deflection ducts with inlet and outlet lines are connected to the inlet and outlet slots. The deflection ducts lead to a suction tank in which it is possible to adjust the negative pressure required for drawing off the electrolyte after flowing through the two partial chambers of the separating chamber. The electrolyte discharged from the coating cells flows off freely and reaches a collection tank and flows from there as a result of gravity into an electrolyte collection container. From the collection container, the electrolyte can again be supplied to the coating cells by means of the pumps. It is also possible to use the collection tank as an electrolyte supply for the pumps.

In accordance with another proposal, the narrow sides of the closing plates facing the strip edges are provided with edge masks as they are known from DE 41 39 066 A1. For example, the edge masks are U-shaped sections which are open toward the strip edges. While the closing plates which can be moved in and out completely seal the box-shaped separating chamber toward the sides thereof, the edge masks surround the sides of the strip without contact. The edge masks shield the strip edges and prevent excessive coating at the strip edges, for example, an excessive tin coating, and, thus, prevent an undesired formation of a bulge. On the other hand, the closing plates are moved on both sides up to the strip edges and, consequently, reduce the separating chamber or flow chamber to the respective dimension of the band width which may vary. Simultaneously, the closing plates cover the inlet slots outside of the band width and, thus, ensure that the electrolyte flows only in the strip area.

Outside of the band width, the anode plates are completely covered by the closing plates which can be moved in and out and which are composed of an electrically non-conductive material, as are the edge masks. Accordingly, no current transfer occurs in these areas from one anode plate the other, for example, when the anode plates have different voltages. The closing plates with the edge masks mounted on the closing plates can be moved and adjusted to the respective band width by means of motor-driven threaded spindles or by means of rocker levers which are connected to a drive and are constructed as parallel levers.

When only one side of the strip is being coated, the edge masks have an additional significance when the anode plate which is not required is not switched off or not removed, in order to avoid that the strip is being coated on the rear side. In these cases, in order to prevent a coating of the currentless, switched-off anode plate because of voltage differences, it has become known from DE 39 01 807 C2 to divide the currentless anode plate horizontally and, thus, to interrupt any short-circuit currents.

In accordance with a preferred proposal according to the present invention, a first coating cell supports the current-carrying roller, a second coating cell supports the deflection roller and the next coating cell again supports a current-carrying roller, etc. By an alternating successive arrangement of the two types of coating cells, it is possible in a cassette-type construction to provide coating plants of any desired length, i.e., of any desired coating capacity. Each coating cell is identically provided with an electrolyte supply and two current connections for switching on and off. The current distribution and the electrolyte flow distribution to the respective slot nozzles are provided within the coating cell.

Another development of the present invention provides that the successively arranged coating cells are locked to each other by means of quick-acting closures. When the coating cells are anchored to each other in this manner, any thermal expansions in longitudinal direction of the plant can have no effect on the gap width of the anode chambers or separating chambers nor on the parallel arrangement of the current-carrying rollers. The individual coating cells rest against each other and no external support structure is required for absorbing the tensional forces of the strip.

It is recommended to provide splash walls for laterally screening the coating cells. Alternatively, it is possible to arrange the coating cells in a splash box. However, in the dry cells according to the present invention, it is not necessary to provide liquid-tight and acid-proof cell housings for the splash walls or for a splash box; these cell housings would additionally have to have a high mechanical stability as is the case in known coating plants.

If, in accordance with an advantageous feature, doors, particularly sliding doors, are arranged in the splash walls or in the splash box, the cassette-type construction of the successively arranged coating cells provides in a simple manner the possibility for inspecting the coating plant during operation. This is because, for a free inspection or a free access, it is only necessary to slide the sliding doors open. Simultaneously, an individual coating cell can be moved laterally out of the coating line without problems with an open sliding door. For a visual inspection, the splash walls or splash boxes can also consist of a transparent material.

In accordance with a proposal of the present invention, support and slide rails are arranged at the bottom of the coating cells for positioning the inserted coating cells or for easily moving the coating cells out of the coating line. It is recommended that lifting levers act on the bottom of each coating cell, wherein the lifting levers can be jointly adjusted by means of a motor and wherein the lifting levers make it possible to lift a coating cell placed and positioned on a lower level in the coating line to a higher level for moving out the coating cell.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENT

Figure 1:
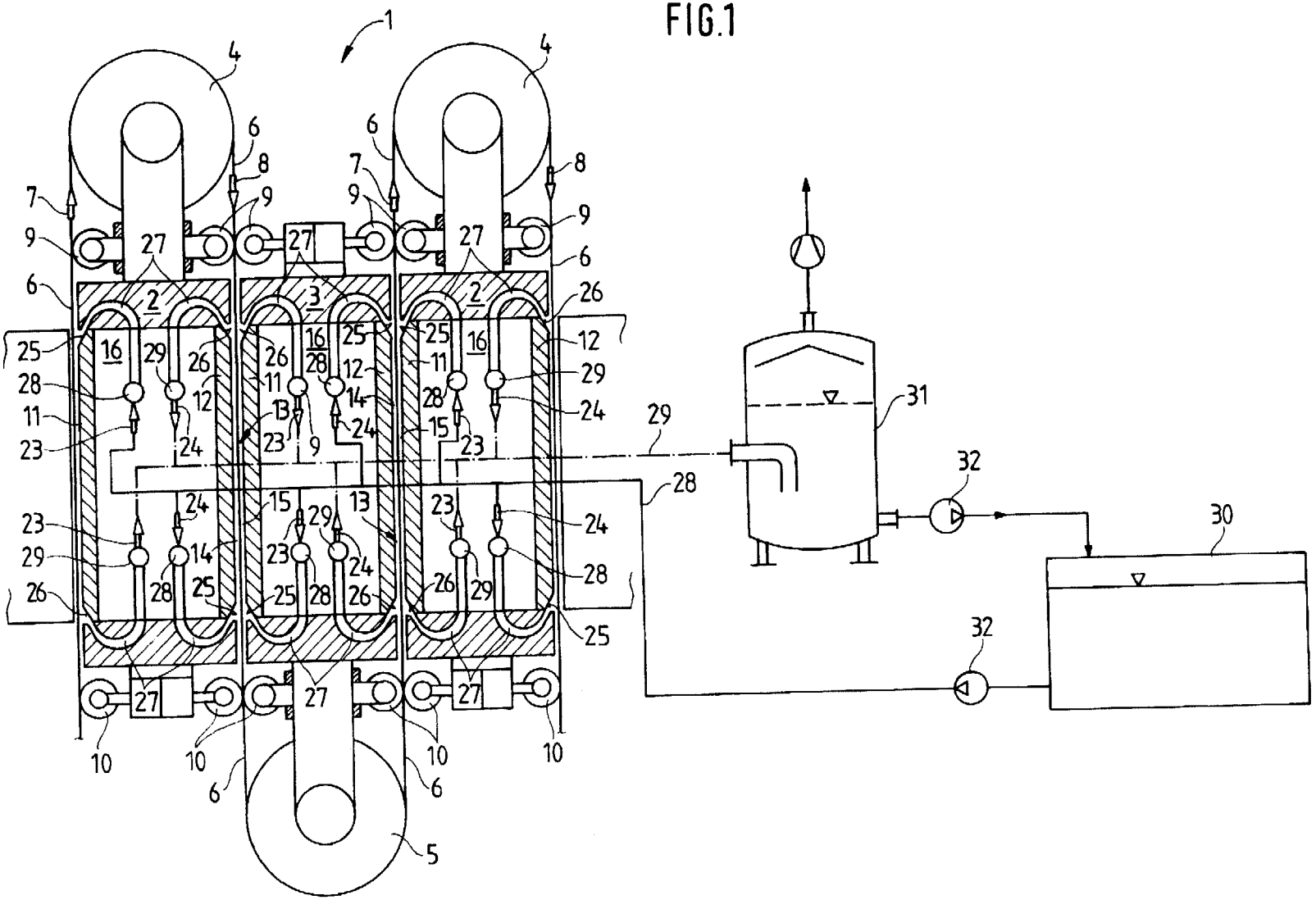
FIG. 1 is a schematic longitudinal sectional view of three successively arranged coating cells of a coating plant according to the present invention, wherein the longitudinal walls of the coating cells are anode plates and the adjacent anode plates of successive coating cells form a separating chamber, and with supply line connections for the coating cells connected to a suction tank and a supply tank or circulating container.

FIG. 1 of the drawing shows three vertically arranged coating cells 2 and 3 of a separating plant or coating plant for coating steel strip. The coating cells 2, 3 are successively arranged in a cassette-type or modular configuration. In the illustrated embodiment, the coating cells 2 are provided at the top thereof with current-carrying rollers 4 and the coating cell 3 between the coating cells 2 has at the bottom thereof a deflection roller 5 which is provided with a rubber layer or plastic coating to prevent damage to the strip. On the other hand, it is also within the scope of the present invention to provide another current-carrying roller at the coating cell 3 instead of a deflection roller. This would result in a reduction of the energy required, and in reduced cooling requirements for each roller, and, because of a 50% reduction of the current, the current-carrying rollers and the current transmission means would be simpler.

The metal strip 6 to be coated with, for example, tin, travels through the coating plant 1 toward the top in the direction of arrow 7 and toward the bottom in the direction of arrow 8.

The metal strip 6 is guided by adjustable guide rollers 9 and 10 arranged at the top and the bottom. The outer walls of the coating cells 2, 3 extending parallel to the metal strip 6 are anode plates 11, 12, wherein always two adjacent anode plates 11, 12 of adjacent coating cells 2, 3 or 3, 2 form a separating chamber 13 which is divided by the metal strip 6 travelling through the separating chamber 13 into two very flat, rectangular partial spaces 14, 15. The coating cells 2, 3 are closed at the narrow sides thereof by end walls 16 which bridge the distance between the two oppositely located anode plates 11, 12 of each coating cell 2 or 3.

Figure 3:
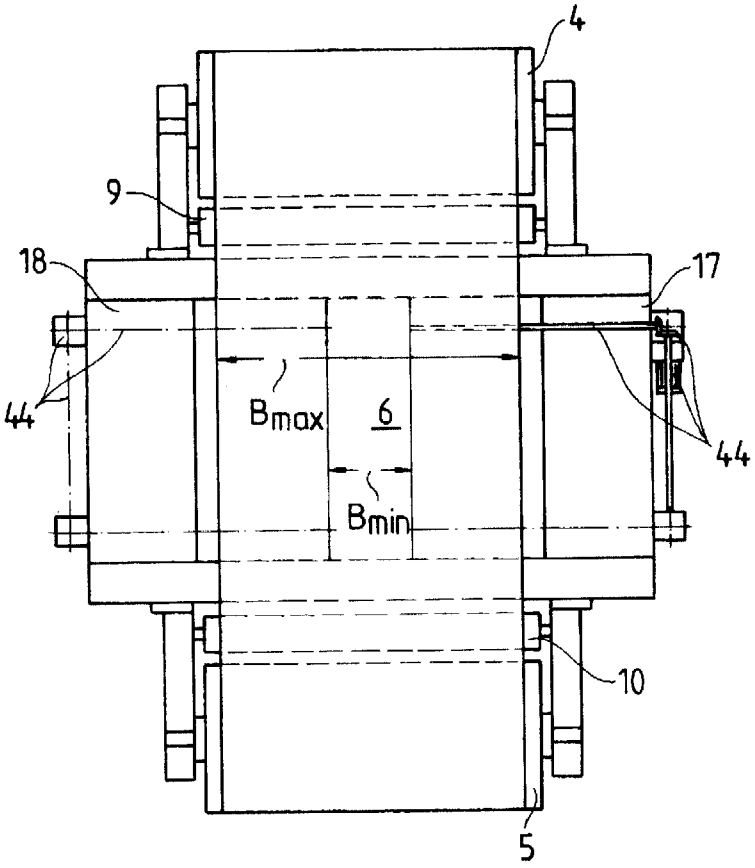
FIG. 3 is a schematic front view of a coating cell with closing plates arranged to the left and right of the coating cell, the closing plates being movable by means of spindles.
Figure 7:
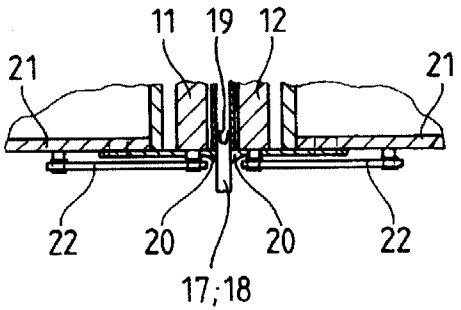
FIG. 7 is an illustration of a detail of a pair of anodes with anode plates which are adjustable relative to each other, showing sealing means for the movable closing plate in the area of the strip edge.

The separating chamber 13 defined by adjacent anode plates 11, 12 of successive coating cells 2, 3 or 3, 2 is open toward the top and the bottom, while the lateral openings toward the left and the right are closed by sealingly arranged closing plates 17, 18, shown in FIG. 3. As shown in FIG. 7, edge masks 19 covering the strip edges are mounted on the narrow sides of the closing plates facing the strip edges.

As also shown in FIG. 7, sealing strips 20 are provided for the closing plates 17, 18 which extend over the entire height of the anodes. The sealing strips 20 are, for example, sealing lips which rest in a V-configuration against the plate, or they are inflatable sealing units, so that always a completely closed sealing effect is achieved for the closing plates 17, 18 which are movable between the anode plates 11, 12. This is also true if, as is the case in the embodiment of FIG. 7, the closing plates 17, 18 are adjustable relative to each other by means of a lever system composed of levers 22 connected in an articulated manner to the cell frame 21, on the one hand, and to the anode plates 11, 12, on the other hand. Thus, even when the anode plates 11, 12 are moved, it is ensured that the chamber is sealed to the sides.

The coating cells 2 and 3 are dry cells. This is because the electrolyte forcibly pumped in a counter-current flow to the travel direction of the metal strip through the separating chambers 13 only fills out the two partial spaces 14, 15 separated by the metal strip 6. For supplying electrolyte to the separating chambers 130 inlet slots 25 or outlet slots 26 extending over the entire width of the anodes are provided at the upper and lower ends of the anode plates 11, 12. Because the supply of electrolyte is in a countercurrent flow, in accordance with the upwardly or downwardly directed arrows 23, 24 in the coating cells 2 or 3, either an inlet slot 25 or an outlet slot 26 is provided at each end of the anode plates 11, 12. The inlet slots 25 and the outlet slots 26 are connected to deflection ducts 27 provided at the top and the bottom, wherein the deflection ducts 27 are connected to inlet and outlet lines 28, 29, respectively, which, in the illustrated embodiment, are supplied with electrolyte from a supply tank or circulating container 30 which is connected to a suction tank 31. For this purpose, pumps 32 are provided in the pipe lines.

Figure 2:
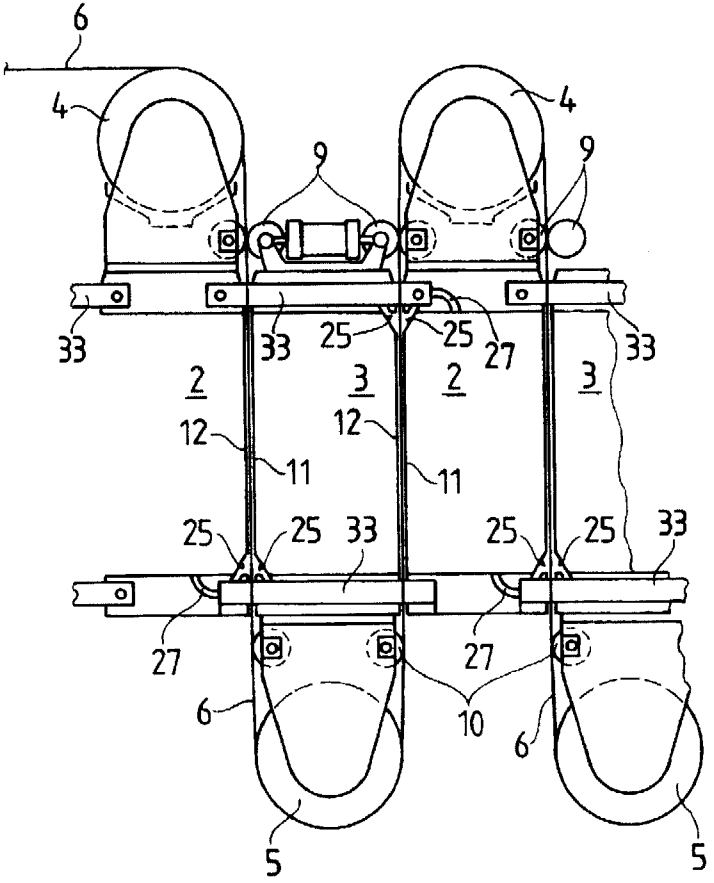
FIG. 2 is a schematic side view of coating cells arranged successively in a cassette-type configuration and clamped together through locking bars arranged at the end faces.

As can be seen in the side view of FIG. 2, in which essentially only the inlet slot nozzles 25 for the electrolyte and the current-carrying and deflection rollers 4 and 5 mounted on support blocks are shown, the individual coating cells 2 and 3 are clamped together by means of locking bars arranged at the end faces, so that thermal expansions in longitudinal direction of the plant cannot have any disadvantageous effect. In the illustration of FIG. 3, which shows the coating cells of FIG. 2 from the left, it can be seen in detail that the closing plates 17, 18 have been moved toward each other by means of a spindle drive 44 to a spacing which corresponds to the smallest width $B_{min}$ of the metal strip 6. The closing plates 17, 18 are variably adjustable relative to each other up to a maximum possible strip width $B_{max}$.

Figure 4:
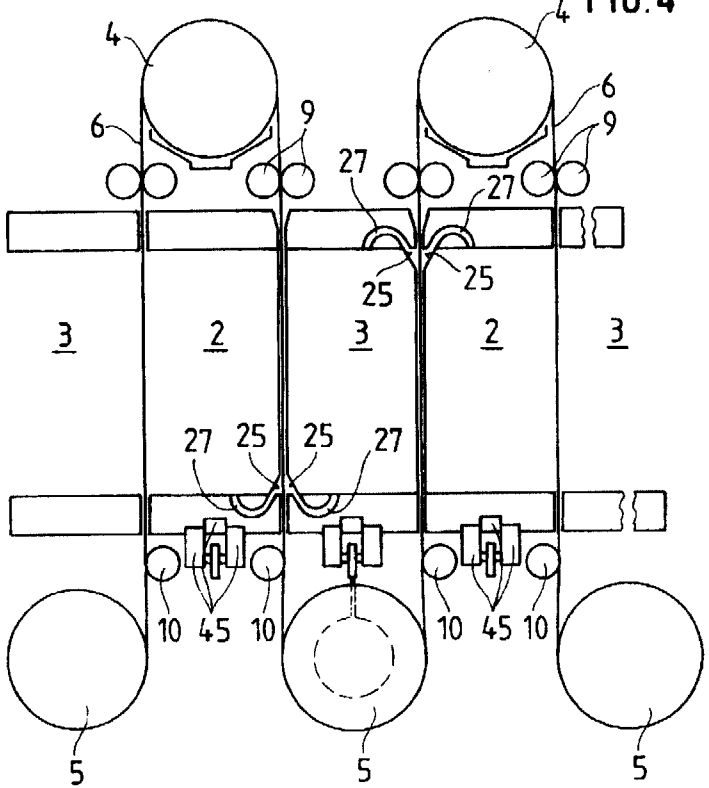
FIG. 4 is a side view of several coating cells used in a coating plant, shown in the position of operation, the coating cells having support and slide rails at the bottom for positioning and laterally moving the coating cells.

In the schematic illustration of FIG. 4, five coating cells 2, 3 are arranged successively; this is easily possible because of the cassette-type or modular construction of the coating cells. In FIG. 4, the coating cells 2, 3 are shown in the position of operation in which they rest with support and slide rails 45 provided at the bottom on a base frame, not shown. As shown in the right hand portion of FIG. 6, the support and slide rails make it possible to laterally slide out the coating cells 2, 3, instead of having to remove the coating cells by lifting them up vertically.

Figure 5:
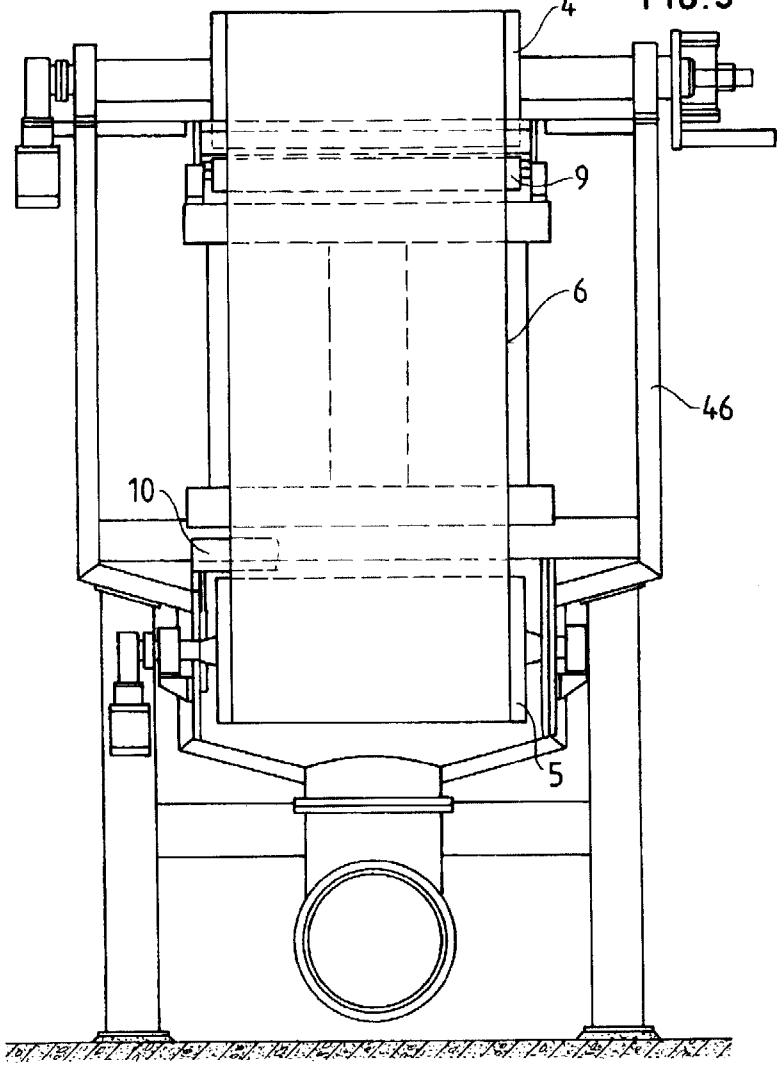
FIG. 5 is a front view of a coating cell mounted in a splash box.
Figure 6:
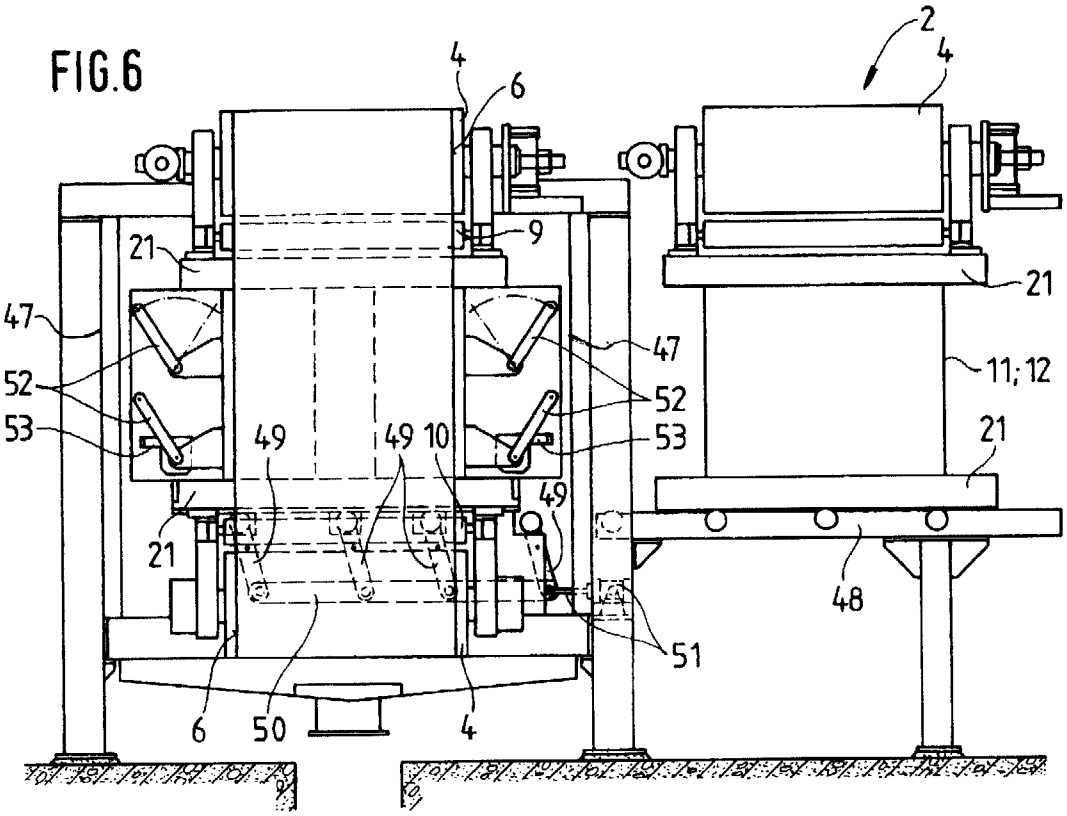
FIG. 6 is a front view of a coating cell for a plant for coating wide strip including mechanisms for moving the closing plates and for raising the coating cell from its mounted position to a level for moving out the coating cell into the moved-out position shown in the right-hand portion of FIG. 6.

In the embodiment of FIG. 5, the coating cells 2 or 3 are mounted in a splash box 46 which simultaneously serves as a support for the bearings of the current-carrying rollers 4 and the deflection rollers 5. In the embodiment of FIG. 6, instead of protecting the immediate surrounding of the coating cells 2, 3 by a splash box 46, splash walls 47 extending in longitudinal direction of the coating plant are provided for the coating cells 2, 3. For inspecting the plant during the continuing operation, on the one hand, and for removing a coating cell 2 or 3 by moving it laterally out of the coating line, as illustrated in connection with the coating cell 2 in the right hand portion of FIG. 6, sliding doors, not shown, are integrated in the splash walls 47, or in the splash box 46 in the embodiment of FIG. 5. After opening the slide doors, the coating cells are freely accessible.

For removing and laterally pulling out the cell frame 21 with the anode plates 11, 12 and the current-carrying roller 4 mounted at the top, the coating cell 2 is lifted from its mounted position shown in FIG. 4 up to a removal level. The coating cell 2 is then in alignment with a roller conveyor 48 on which the coating cell 2 can then be pulled out. For raising or lowering the coating cell 2, lifting levers 49 pivotally mounted at the bottom are connected to the cell frame 21, wherein the lifting levers 49 are moved and adjusted by means of a common pull rod 50 by means of a drive 51, for example, a cylinder drive.

FIG. 6 additionally shows another embodiment of a device for adjusting the closing plates 17, 18 to $B_{min}$ or $B_{max}$ or dimensions therebetween, wherein this embodiment differs from that of FIG. 3. In FIG. 6, the device for adjusting the closing plates 17, 18 includes a pair each of parallelogram levers 52 which are arranged to the left and right of the two adjacent anode plates 11, 12 which form a pair of anodes. The parallelogram levers 52 are pivoted by means of a pneumatic/hydraulic motor drive for adjusting the closing plates 17, 18 to the desired strip width. The position of the parallelogram lever pairs 52 shown in solid lines in FIG. 6 corresponds to the maximum width $B_{max}$ of the metal strip to be coated and the swung-in position shown in dash-dot lines corresponds to the smallest possible width $B_{min}$ of the metal strip 6 to be coated.

While specific embodiments of the invention have been shown and described in detail to illustrate the inventive principles, it will be understood that the invention may be embodied otherwise without departing from such principles.

I claim:

1. A separating plant for metals from a metal-containing electrolyte, particularly for coating steel strip, the separating plant comprising a plurality of vertical coating cells mounted successively next to one another in a longitudinal direction of the plant, the coating cells having walls, wherein the walls are anode plates and the adjacent anode plates of successive coating cells located opposite each other define a separating chamber therebetween, wherein the anode plates have upper and lower ends and a width, further comprising inlet and outlet slots extending over the entire width of the anode plates provided at the upper and lower ends of the anode plates, the successive coating cells having alternatingly in the longitudinal direction an upper deflection roller and a lower deflection roller, wherein the metal strip to be coated is guided around the upper and lower deflection rollers and through the separating chambers, wherein at least one of the upper deflection rollers is a current-carrying roller, and comprising pumps for introducing a circulated electrolyte flow into each separating chamber.

2. The separating plant according to claim 1, wherein the strip to be coated travels through the separating chambers in a travel direction, and wherein the pumps are configured to introduce the electrolyte flow into each separating chamber in a direction opposite the strip travel direction.

3. The separating plant according to claim 1, further comprising inlet and outlet lines and deflection ducts connected between the inlet and outlet slots and the inlet and outlet lines.

4. The separating plant according to claim 1, wherein each separating chamber has lateral openings, further comprising movable closing plates at the lateral openings.

5. The separating plant according to claim 4, wherein the strip to be coated has edges and wherein the closing plates have narrow sides adapted to face the strip edges, further comprising edge masks mounted on the narrow sides of the closing plates.

6. The separating plant according to claim 1, wherein all upper deflection rollers are current-carrying rollers.

7. The separating plant according to claim 1, further comprising quick-acting closures for locking the successively arranged coating cells to one another.

8. The separating plant according to claim 1, further comprising splash walls laterally surrounding the coating cells.

9. The separating plant according to claim 8, wherein the splash walls have doors.

10. The separating plant according to claim 1, wherein each coating cell has a bottom, further comprising support and slide rails at the bottom of each coating cell.

11. The separating plant according to claim 10, further comprising lifting levers connected to the bottom of each coating cell.

12. The separating plant according to claim 1, wherein each mounting cell is mounted in a splash box.

* * * * *